United States Patent [19]

Morris

[11] 3,958,529

[45] May 25, 1976

[54] WORK-TIME INDICATOR

[76] Inventor: Ralph E. Morris, 7507 Parkwood Court Apt. 204, Falls Church, Va. 22042

[22] Filed: July 29, 1975

[21] Appl. No.: 599,970

[52] U.S. Cl. ..... 116/133; 235/83; 35/24 A

[51] Int. Cl.[2] ..... G09F 9/00

[58] Field of Search ..... 235/83, 89, 88; 58/148–151; 116/133; 35/24 R, 24 A, 24 B

[56] References Cited

UNITED STATES PATENTS

| | | | |
|---|---|---|---|
| 717,241 | 12/1902 | Mercer | 116/133 |
| 2,961,157 | 11/1960 | Sunico | 235/83 |
| 3,883,970 | 5/1975 | Campbell | 35/24 B |

*Primary Examiner*—Ulysses Weldon
*Attorney, Agent, or Firm*—Laurence, Stokes & Neilan

[57] ABSTRACT

A circular clock face bearing time indicia equally spaced in a concentric relationship thereon providing a base to support and correlate time quantity indicators. A plurality of arcuate segmented indicators marginally disposed along the perimeter of the face are manually positionable to visually display certain combinations of time indicia corresponding to mandatory work hours, and a plurality of sector indicators slidably supported on the inner portion of the face are manually positionable to visually indicate certain combinations of time indicia corresponding to employee work time. The sector indicators and segmented indicators are cooperatively organized for visually indicating proper correlations of time combinations.

10 Claims, 2 Drawing Figures

WORK-TIME INDICATOR

BACKGROUND OF THE INVENTION

The invention relates to indicating devices for the visual correlation of particular time quantities, and more particularly relates to a work-time indicating device permitting an employee to display his intended work schedule in relation to the mandatory and optional work schedule designated by his employer.

A concept of work-hour scheduling known as "flexitime" or "flexible work schedules" began in Europe toward the latter part of the 1960's and is presently come into the American work culture. Under this scheduling concept an employee is given flexibility as to which hours he may work to fulfill his usual required eight working hours. Flexitime comprises two distinct kinds of time: core time which is that part of a work day during which all employees within a specified group must be at work, and flexible time which is all remaining time within which the employee is free to choose his time of arrival and departure from the office.

Although such a scheduling provides great flexibility to the employee in choosing his own working hours, management is confronted with the problem of being assured of the availability of employees to handle tasks during the day. The core time mitigates the major portion of this problem by requiring all employees to be at work during the busiest part of the day when employees are most needed. But often unforeseen work overflow may occur outside of core time hours or an emergency meeting of certain employees may need to be held or minimum attendance is required to provide maintenance of minimum services such as telephone and public contact coverage. Thus, the supervisor has the problem of not knowing which staff members will be at work for what hours during the day under a flexible work schedule.

Another problem that arises is that of the employee accurately determining the times he must be in the office and the time when his work day is completed. This problem is exacerbated where the employee is unfamiliar with mathematical techniques and may be confused by tables, charts or punch clocks. For example, an employee may experience difficulty when having to add 8 hours (work) and 45 minutes (lunch) to a starting time of 9:45 to determine his proper quitting time.

A further closely allied problem is one that faces the supervisor of his being assured of 8 hours of attendance by each employee when starting and stopping times of each employee may vary.

Therefore, it is an object of this invention to provide a visual indicating device capable of quick and easy interpretation allowing a supervisor to determine the expected work schedules of each employee during the day.

It is a further object of this invention to provide a time indicator device permitting an employee to quickly determine his time on the job in relation to one or more core times of mandatory working hours.

It is a further object of this invention to provide a time indicator device settable by an employee to quickly determine his permitted departure time from work.

SUMMARY OF THE INVENTION

The objects and purposes of this invention are achieved by a work-time indicating device including a face bearing time indicia equally spaced thereon with spacing between indicia denoting time quantities. First indicator segments slidably supported on the face are settable in cooperation with the face indicia for visually displaying the times of a given day during which employees are required to work. Second indicator segments slidably supported on the face are positionable by the employee to visually indicate his time on the job during that day and are so sized to cover the total hours an employee must work for automatically indicating departure time. The second indicator segments are organized to visually indicate whether the employee has properly correlated the same with the first indicator segments.

Other objects, features and advantages of the invention will be readily apparent from the following description of the preferred embodiment taken in conjunction with the appended claims and accompanying drawings.

DESCRIPTION OF THE PREFERRED EMBODIMENT

Figure 1:
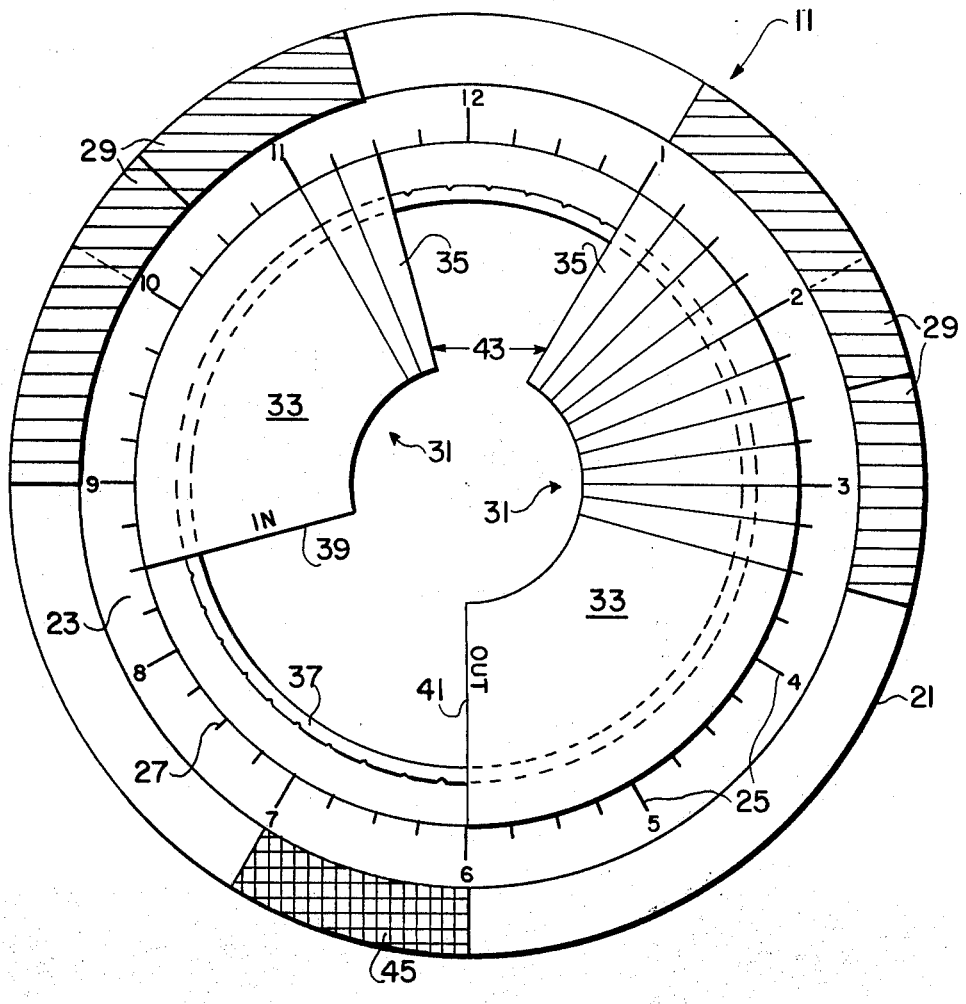
FIG. 1 shows a face view of the work-time indicating apparatus of the present invention.

Shown in FIG. 1 is the work-hour indicating device of the present invention which serves as a medium for an employee to keep an account of his or her own schedule while permitting the supervisor to be apprised of the expected work schedule of that employee.

The work-hour indicator referred to generally as numeral 11 includes a face member 21 servicing as a supporting structure for several time indicators which will be described hereinafter. The face member 21 is circular in configuration including a circular band 23 spaced intermediate the circumference and having a plurality of equally spaced indicia 25 positioned therearound. The indicia comprises the numerals 1 through 12 inclusive being set in a relationship similar to a clockface for indicating a 12-hour work day. Quarter hour markings 27 are also provided on the band 23 equally spaced between the indicia 25. The face is numbered similar to a clock face for providing less confusion with employees, but other numbering configurations may be realized such as a 24-hour display.

Four arcuate segmented indicators 29 are slidably supported in the margin area between the indicia band 23 and circumference of the face 21. The segmented indicators 29 are partial sectors with respect to the circular face, having bounding radii which mark two particular times for displaying a time quantity lying between those times. The segmented indicators are secured to the face member 21 in any conventional manner, e.g. notched tracks, to permit manual movement of the indicators for fixing the same in radial alignment along quarter hours to identify core time as designated by management.

As shown in FIG. 1, the indicators 29 arcuately embrace 1½ hours each and are capable of overlapping one another along the margin area for depicting variations between 1½ hours and 6 hours by arranging the segments in overlapping and/or adjacent relationships. The indicators 29 may also be positioned in other than one consecutive time coverage indicator as illustrated in FIG. 1 where the indicators correspond to two periods, one from 9:00 A.M. through 11:30 A.M. and the other from 1:00 P.M. through 3:30 P.M.

The indicators 29 are positioned in cooperation with the indicia on the band 23 for visually displaying an indication of a time quantity corresponding to "core time". Core time is that time during the day which an employee must be on duty or be in some category of leave — sick leave, vacation leave, etc. In some work environments, two work peak times occur during the day when it is necessary to have a full staff. But between these two periods full staffing is not required and employees are given flexibility in deciding how long to take lunch hours depending upon errands to run, doctor appointments, etc.

The use of four overlappable 1½ hour indicators is found to cover the practical core times used by employers, although unusual core times may be set by custom fitting of indicators where required. Thus, as shown in FIG. 1, split core times can be shown by two periods variable from 1½ hours to 3 hours.

The core time indicators may take on other shapes, as for example, transparent colored overlays which may be set to slide directly atop the indicia band 23 for visually indicating those times in which an employee must be at work.

A work-time indicator designated generally by the numeral 31 comprises a plurality of sectors 33 and 35 slidably supported on the inner portion of the face 21. The sector indicators 33 and 35 are rotatably positionable on a concentric track 37 notched at ¼ hour intervals around the center of the face 21 so as to securely position the sectors in line with the quarter hour marks on the face. Other positionable means may suggest themselves to those skilled in the art for holding the work-time indicator sectors in place.

As shown in FIG. 1, two different sized sectors are chosen: two large sectors 33 equal in time coverage along the indicia band 23 of the time coverage of the first and last core times, respectively, and a plurality of small sectors 35 equal in time coverage along the indicia band 23 of ¼ hour and numbering in plurality to equal the 8 hour work shift when added with the two large sectors 33. That is to say that the total time coverage of the sectors indicators equals the total hours an employee is required to work each day — usually 8 hours.

The sectors are positioned by the employee so that the "earliest" large wedge 33 has its leading edge 39 aligned with his starting time. The edge 39 is marked with the word "IN" inscribed thereon. The quarter hour sectors 35 are then positioned so as to leave a space 43 during any time away from the job between core periods including lunch. The trailing edge 41 of the latter sector 33, which edge is marked "OUT", will then automatically determine quitting time for that employee. The positioning of the sectors must be such that they cover the core time segments.

The sector and segment indicators may be color coded and/or positioned to overlap one another along the indicia band to visually display to the employee that he has properly correlated his working time with the core time.

In many operations the core time is not split and the lunch time has an established duration. A work-time indicator for such a time schedule may include a single sector covering the employees work time plus lunch time. In such an arrangement, the employee sets the leading edge of the single sector at his starting time, making sure the work-time indicator properly correlates with the core time. Thus his finishing time is automatically indicated by the trailing edge of the single sector.

Often there are certain hours of the day during which the building facilities are not available for use and during which management will not allow regular work time to be performed. Thus an indicator 45 is positioned to cover the indicia band 23 between the numeral markings 6 and 7 for visually signalling that an employee is not permitted to move the work-time indicator 31 into this area. Further, the non-working time indicator 45 may contain mechanical abutments within its sector of the face for disallowing the work-time indicator 31 to slide over this sector.

Figure 2:
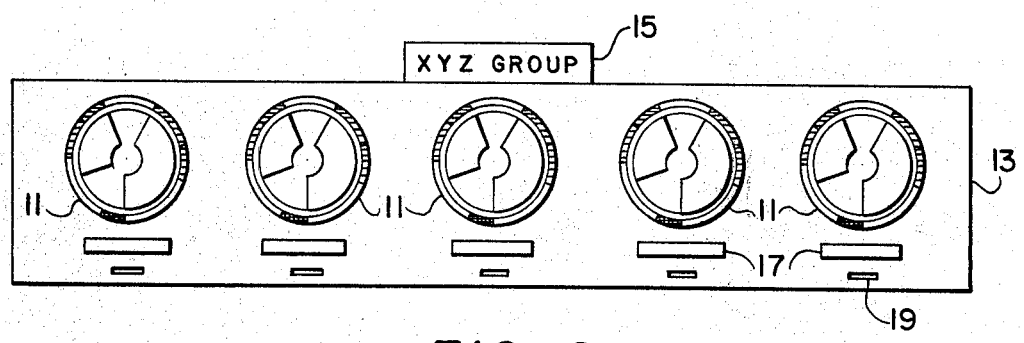
FIG. 2 shows a plurality of work-time indicators of FIG. 1 constructed for viewing in a mounting panel.

FIG. 2 illustrates five work-hour indicator devices of the present invention shown as numeral 11, constructed in a row relationship on panel 13. The panel 13 is approximately 7 inches wide and 35 inches in length, and has interlocking capabilities (not shown) permitting any number of such panels to be secured one on top of another in a row-stacked array. The interlocked panels may be hung upon a convenient wall for employee and supervisor use.

An optional organizational name plate 15 may be secured to the top of the array of panels for appropriate identification and under each indicator face 11 may be located a small name plate 17 bearing the employees name or identification number. Also under each indicator face is a slot 19 for receiving an employee's identification card which may be notched to serve as a key to unlock the indicator 11 for permitting movement of the indicator components by the employee. Other appropriate key locking means may be used in order to keep unauthorized persons from changing the work-time indicators.

Thus employees may set their time indicators at the end of the day to indicate the next day's expected work hours, for allowing the supervisor to plan accordingly. Also when the employee arrives to work he may make any necessary changes.

It should be understood, of course, that the foregoing disclosure relates to a preferred embodiment of the invention and that other modifications or alterations may be made therein without departing from the spirit or scope of the invention as set forth in the appended claims.

What is claimed is:

1. A work-time indicating device permitting an employee to quickly determine his day's working time in relation to preset mandatory work hours in which he must work, comprising:

face means;

indicia means systematically positioned on said face means corresponding to particular times of day with spacing between said indicia means corresponding to time between said particular times;

first indicator means supported on said face means for visually indicating at least two first time quantities corresponding to mandatory work hours during specific times of day by visually cooperating with said indicia means; and second indicator means slidably supported on said face means and manually positionable in cooperation with said indicia means for visually indicating second time quantities corresponding to day's working time, said second indicator means visually cooperating with said first indicator means for indicating correlation of said first time quantities with said second time quantities.

2. A work-time indicating device permitting an employee to quickly determine his day's working time in relation to preset mandatory work hours in which he must work, comprising:

face means;

indicia means circularly disposed on said face means and arranged in an equally spaced configuration therearound corresponding to particular times of day with spacing between indicia means corresponding to equal time between said particular times;

first indicator means supported on said face means for visually indicating at least two first time quantities corresponding to mandatory work hours during specific times of day by visually cooperating with said indicia means; and second indicator means rotatably supported about the center of said indicia means and manually positionable in cooperation with said indicia means for visually indicating second time quantities corresponding to day's working time, said second indicator means visually cooperating with said first indicator means for indicating correlation of said first time quantities with said second time quantities.

3. A work-time indicating device of claim 2 wherein said first and second indicator means including sector means defining sector-like indicators with respect to the circular disposition of said indicia means, the bounding radii of said sector means marking the boundaries of said respective first and second time quantities.

4. A work-time indicating device of claim 3 wherein said first indicator means color contrasting from said face means in proximity of said indicia means.

5. A work-time indicating device of claim 3 wherein said second indicator means comprising a plurality of time-quantity indicators.

6. A work-time indicating device of claim 5 wherein said first indictor means visually indicating two first time quantities; and said second indicator means comprising a plurality of time-quantity indicators including:

two indicators, one of said two indicators corresponding to a time-quantity duration equal to one of said two first time quantities, and other of said two indicators corresponding to a time quantity duration equal to other of said two first time quantities; and remaining plurality of said indicators disposed between said two indicators being of time quantity duration equal to ¼ hour.

7. A work-time indicating device of claim 3 wherein said first indicator means comprising a plurality of indicators slidably supported on said face means.

8. A work-time indicating device of claim 7 wherein said first indicator means being overlappable one with the other providing variable length first indicator means.

9. A work-time indicating device of claim 3 including third indicator means including sector means for visually indicating third time quantity corresponding to available working time, said third indicator means for indicating correlation of said third time quantity with said second time quantities.

10. A work-time indicating device permitting an employee to quickly determine his day's working time, including any break times, in relation to preset mandatory work hours in which he must work, comprising:

face means;

indicia means circularly disposed on said face means and arranged in an equally spaced configuration therearound corresponding to particular times of day with spacing between indicia means corresponding to equal time between said particular times;

a first indicator supported on said face means for visually indicating a first time quantity corresponding to mandatory work hours during a specific time of day, said first indicator including sector means defining sector-like indicators with respect to the circular disposition of said indicia means and bounding radii of said sector means marking the boundaries of said first time quantity; and a second indicator rotatably supported about the center of said indicia means and manually positionable in cooperation with said indicia means for visually indicating a second time quantity corresponding to day's working time including any break times, said second indicator including sector means defining sector-like indicators with respect to the circular disposition of said indicia means and the bounding radii of said sector means marking the boundaries of said second time quantity, and said second indicator color contrasting from said first indicator for visual indication of correlation of said first time quantity with said second time quantity.

* * * * *